US006179222B1

(12) United States Patent
Stecher

(10) Patent No.: US 6,179,222 B1
(45) Date of Patent: Jan. 30, 2001

(54) SELF-CLEANING DISPENSING ASSEMBLY

(75) Inventor: Jürgen Stecher, Mariabrunn (DE)

(73) Assignee: J. Wagner GmbH, Friedrichshafen (DE)

( * ) Notice: Under 35 U.S.C. 154(b), the term of this patent shall be extended for 0 days.

(21) Appl. No.: 09/420,628

(22) Filed: Oct. 20, 1999

(30) Foreign Application Priority Data

Oct. 26, 1998 (DE) ..... 298 19 052 U

(51) Int. Cl.[7] ..... B05B 15/02
(52) U.S. Cl. ..... 239/112; 239/119; 239/127
(58) Field of Search ..... 239/119, 112, 239/106, 104, 127; 417/236, 238

(56) References Cited

U.S. PATENT DOCUMENTS 1,816,555 * 7/1931 Ward ..... 239/112 X
4,522,789 * 6/1985 Kelly et al. ..... 239/127 X
4,746,063 * 5/1988 Roberts ..... 239/119 X

* cited by examiner

*Primary Examiner*—Lesley D. Morris
(74) *Attorney, Agent, or Firm*—Pandiscio & Pandiscio

(57) ABSTRACT

In a device (1) for delivering liquid or paste-like media to a coating unit (2) by a delivery pump (3) which is connected to a supply reservoir (7) via a suction line (5) and is connected to the coating unit (2) via a delivery line (6), the device can be connected directly or via the coating machine (2) to the suction line (5) in order to clean the delivery pump (3), the suction line (5) and/or the delivery line (6).

Figure 1:
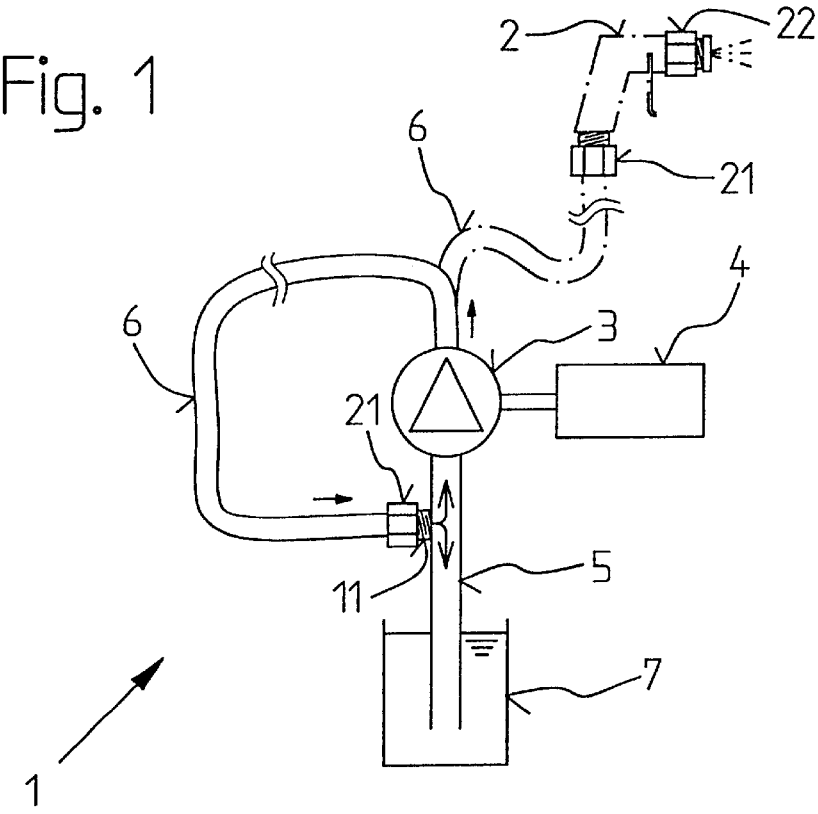

Using the delivery pump (3), this design allows the suction line (5) also to be cleaned in a simple manner, so that deposits in the suction line (5) can be reliably removed.

9 Claims, 3 Drawing Sheets

SELF-CLEANING DISPENSING ASSEMBLY

The present invention concerns a device for pumping liquid or paste media to an applicator, for example a spray gun, with a pump which is connected to a reservoir tank via a suction line and to the applicator by a pump line.

In pumping devices of this type, the suction line is often provided with a relatively large internal diameter in order to ensure that the paste materials are reliably sucked in. The flow speeds in the suction lines are therefore slow, with the effect that deposits on the inner wall of the suction line are unavoidable, as is time-consuming cleaning work. This is achieved by using the pump to draw up a solvent or water from a separate container and directing this solvent or water through the components which are involved in pumping the materials. Although the pump, the pump line and the fittings do get flushed through and cleaned with this method, the deposited material in the suction line is not carried away in the required fashion because the speeds of flow are slow as a result of the large internal diameter. From time to time, therefore, it is essential to replace the blocked suction line in these pumping devices.

The task of the present invention is therefore to configure the device for pumping liquid or paste media to an applicator of the type mentioned initially in such a way that the suction line can also be cleaned using the pump in a straightforward and satisfactory manner. The constructional complexity required to achieve this should be kept at a low level whilst, nevertheless, the reliable removal of deposits from the suction line should be assured.

In accordance with the present invention, this is achieved in a device for pumping paste media to an applicator of the aforementioned type in that the pump line can be connected to the suction line directly or by means of the applicator in order to clean the pump, the suction line and/or the pump line.

At the same time, it is advantageous to provide the suction line with a connection pipe in the form of a sleeve to which the pump line or the applicator can be connected so as to prevent the leakage of liquid and to equip the connection pipe with a check valve which, in a preferred embodiment, is spring loaded, with it further being advantageous to provide the connection pipe with one or more nozzle apertures worked into its sleeve and opening into the suction line. At the same time, the sleeve can be provided with diametrically opposite nozzle apertures running in the lengthways direction of the suction line, although it is also possible for the nozzle apertures of the connection pipe to be configured as swirl nozzles.

The pump line or the applicator can be connected to the connection pipe of the suction line in a simple manner by means of a union nut provided on the applicator, also the connection pipe should be arranged in a bend of the suction line.

In a suction line provided with a cleaning aperture, the closure flange of the suction line can be provided with a connection pipe for the pump line or the applicator.

If a device for pumping liquid or paste media to an applicator is embodied in accordance with the present invention, it is a very straightforward and quick matter reliably to clean the components which are involved in pumping a medium, in particular however the suction line. Because the pump line can be connected to the suction line without difficulty, it is namely possible to pump the medium, a solvent or water, into the suction line at high speed and in a circuit, with the result that deposits in the suction line are carried away and the suction line is therefore cleaned to a sufficient extent. The proposed embodiment for the operation of the pumping device is therefore improved significantly with little constructional complexity and malfunctions, in particular lengthy interruptions in operation, are avoided.

Figure 5:
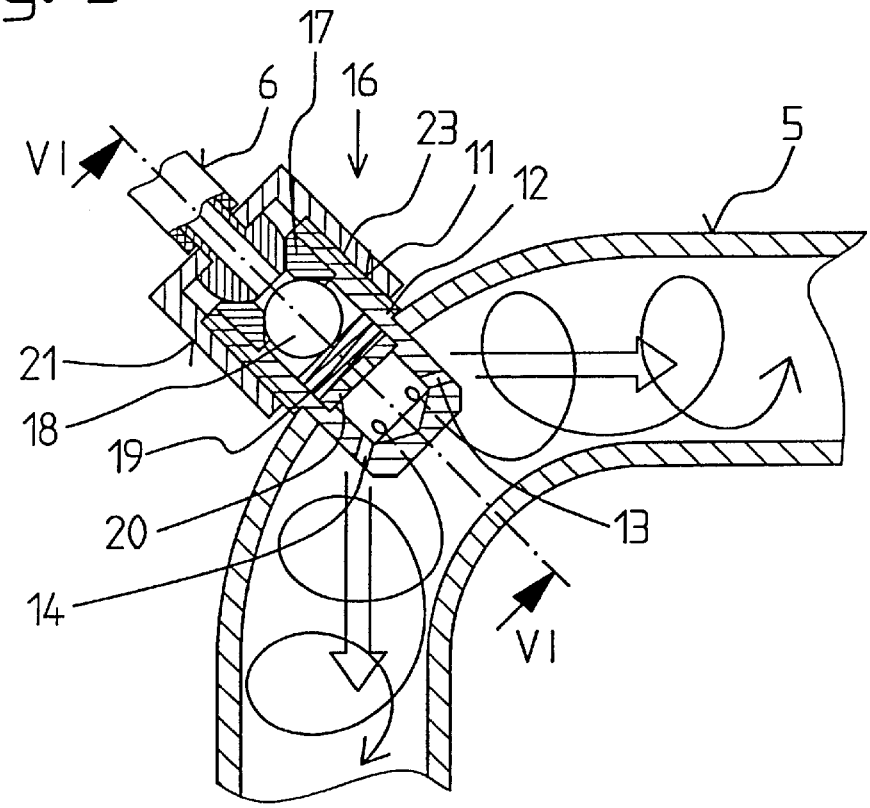
Figure 6:
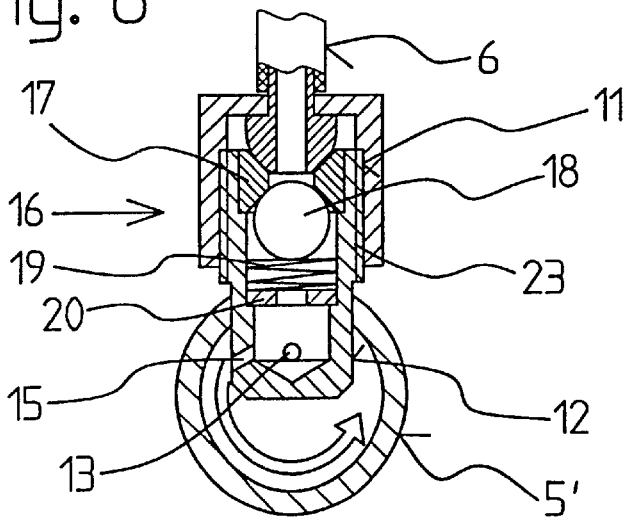

The drawing shows certain sample embodiments of the device for pumping fluid or paste media to an applicator in accordance with the present invention, the details of which are explained below. In the drawing, FIGS. 1 to 4 show pumping devices of various embodiments, in each case in a schematic representation, FIG. 5 shows the connection pipes fitted on the suction lines of the pumping devices in accordance with FIGS. 1 to 4, as a sectional view and FIG. 6 shows a section along line VI—VI in FIG. 5.

The devices shown in FIGS. 1 to 4 and identified with 1, 1', 1" and 1'" are used for pumping liquid or paste media out of reservoir tanks 7 or 8 to an applicator 2 in the form of a spray gun and each principally consists of a pump 3, which can be driven by an electric motor 4, as well as a suction line 5 and a pump line 6 by means of which the delivery pump 3 is connected to the reservoir tank 7 or 8 or to the applicator 2. When the pump 3 is switched on, the medium in the reservoir tank 7 or 8 is therefore pumped to the applicator 2 in a continuous flow.

In order to be able to clean the components involved in pumping, namely the pump 3, the pump line 6 and, in particular, the suction line 5, in a short time, to a sufficient degree and almost automatically, the pump line 6 can be connected to the suction line 5 either directly or by means of the applicator 2. In order to achieve this, as can be seen in detail in FIGS. 5 and 6, the suction line 5 is provided with a connection pipe 11 onto which the pump line 6 or the applicator 2 can be screwed by means of a union nut 21 or 22 to provide a fluid-tight connection. The connection pipe 11 is embodied as a sleeve 12 and, in order to function as required, it is equipped with an external thread 23 which holds on the union nut 21 or 22.

A check valve 16 is installed in the connection pipe 11, and the check valve 16 consists of a valve body 17 pressed into the sleeve 12, a moving valve body 18 and a valve spring 19 which acts on the valve body 18 and on a plate 20 which is inserted in the sleeve 12. When a medium flowing in through the pump line 6 acts on the valve body 18, the check valve 16 is automatically opened and the medium can flow into the suction line 5. The sleeve 12 is provided with two diametrically opposed nozzle apertures 13 and 14 running in a lengthways direction and, as can be seen from FIG. 6, with a nozzle aperture 15 arranged around the circumference, and consequently the medium which is flowing out is not just accelerated so it flows into the suction line 5 at a high speed, but also the medium emerges with a swirl. As a result, deposits in the suction line 5 are reliably transported away.

Figure 2:
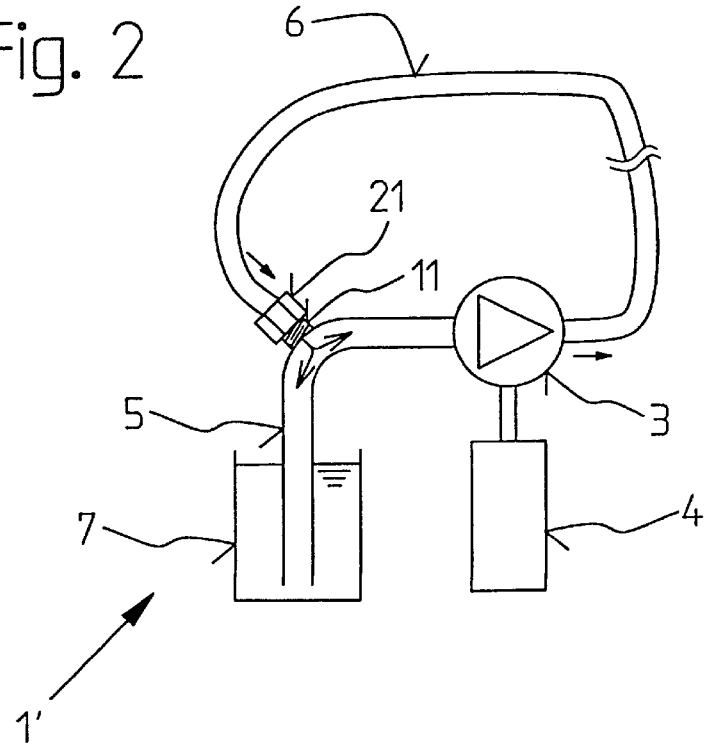
Figure 3:
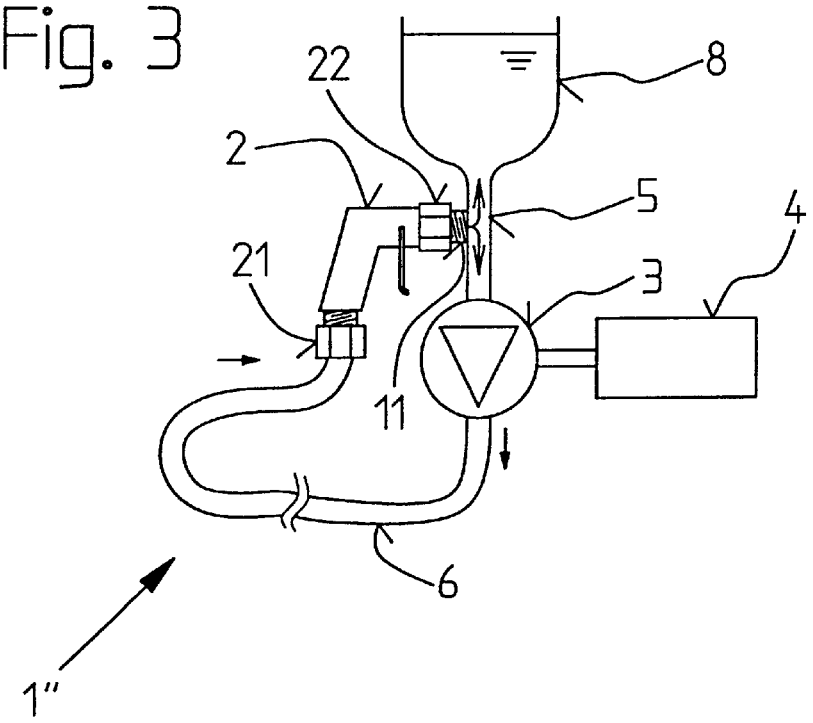
Figure 4:
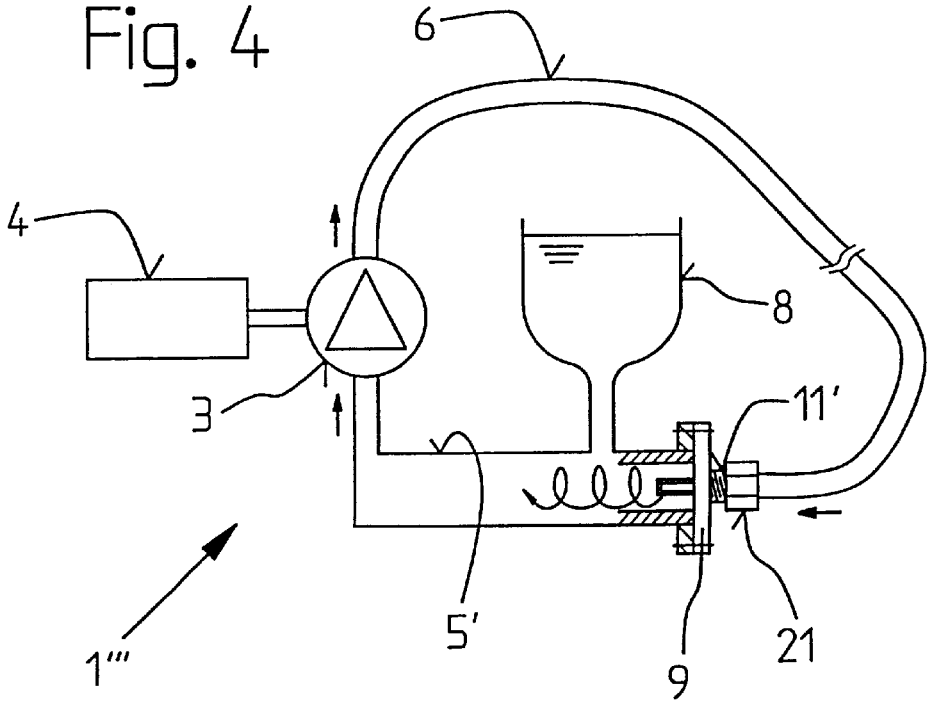

In the device 1 in accordance with FIG. 1, the pump line 6 is attached to the connection pipe 11 fixed onto the suction line 5, with the pump line 6 being attached there by means of the union nut 21 which holds the applicator 2 onto the pump line; the same applies to the device 1' in accordance with FIG. 2. In this case, however, the connection pipe 11 is arranged in a bend in the suction line 5. In accordance with FIG. 3, the applicator 2 is connected to the connection pipe 11 of the suction line 5 by the union nut 22 with a top container serving as the reservoir tank 8 in this case. In accordance with FIG. 4, the suction line 5' of the device 1'" is provided with a cleaning aperture which is equipped with a closure flange 9. The connection pipe 11' for transferring a medium from the pump line 6 into the suction line 5' is, in this embodiment, inserted into the closure flange 9, with the result that the pump line 6 can be attached to the connection pipe 11' using the union nut 21 and a medium can flow into the suction line 5' with a high speed of flow.

What is claimed is:

1. A dispensing assembly for dispensing a fluid; the assembly comprising an applicator (2), a pump (3) connected to a reservoir tank (7 or 8) via a suction line (5) and to the applicator (2) by a pump line (6), wherein the pump line is disconnectable from said applicator and is connectable to the suction line (5) directly and said applicator is connectable to the suction line in order to clean the pump (3), the suction line (5) and the pump line (6).

2. The assembly in accordance with claim 1, wherein the suction line (5) is provided with a connection pipe (11) in the form of a sleeve (12) to which the pump line (6) and the applicator (2) are connectable so as to prevent leakage of liquid.

3. The assembly in accordance with claim 2, wherein the connection pipe (11) is equipped with a check valve (16).

4. The assembly in accordance with claim 2 wherein the connection pipe (11) is provided with a nozzle aperture in said sleeve (12) and opening into the suction line (5).

5. The assembly in accordance with claim 4, wherein the sleeve (12) is provided with diametrically opposite nozzle apertures (13, 14) running in a lengthways direction of the suction line (5).

6. The assembly in accordance with claim 5 wherein the nozzle apertures (15) of the connection pipe (11) are configured as swirl nozzles.

7. The assembly in accordance with claim 2, wherein the pump line (6) and the applicator (2) are connectable to the connection pipe (11) of the suction line (5) by means of a union nut (22) provided on the applicator (2) and a union nut (21) provided on the pump line (6).

8. The assembly in accordance with claim 2, wherein the connection pipe (11) is arranged in a bend of the suction line (5).

9. The assembly in accordance with claim 1, wherein the suction line is provided with a cleaning aperture, and a closure flange (9) of the suction line is provided with the connection pipe for a selected one of the pump line (6) and the applicator (2).

* * * * *